US005466193A

United States Patent [19]

Hixson

[11] Patent Number: 5,466,193

[45] Date of Patent: Nov. 14, 1995

[54] T-SHAPED FOUL LINE CONSTRUCTION JOINING LANE SECTIONS

[75] Inventor: Kenneth L. Hixson, Mechanicsville, Va.

[73] Assignee: AMF Bowling Inc., Mechanicsville, Va.

[21] Appl. No.: 253,082

[22] Filed: Jun. 2, 1994

[51] Int. Cl.[6] ..... A63D 1/00

[52] U.S. Cl. ..... 473/115; 473/117

[58] Field of Search ..... 473/115, 116, 473/117; 52/273, 285, 295, 408, 459, 395, 460, 464, 318, 319

[56] References Cited

U.S. PATENT DOCUMENTS 2,039,580 5/1936 Borders ..... 473/115
3,555,759 1/1971 Kamberg et al. ..... 52/318
3,906,692 9/1975 Boiardi ..... 52/318
5,183,362 2/1993 Heddon ..... 473/115

*Primary Examiner*—William M. Pierce
*Attorney, Agent, or Firm*—Bacon & Thomas

[57] ABSTRACT

A bowling alley construction includes an approach section, a lane section and a foul line coupling between the approach and lane sections. The foul line has an elongated relatively flat base portion and an upwardly and transversely extending riser which extends across the width of the lane and/or approach section. A synthetic panel abuts one side of the riser and is fastened to one section of the alley through the base portion of the foul line coupling. A method for resurfacing bowling alleys with a synthetic panel and an L or T-shaped foul line coupling is also disclosed. In that method, a proximal end of the synthetic panel is then fastened to one section of the alley and to the base portion of the foul line coupling.

3 Claims, 2 Drawing Sheets

T-SHAPED FOUL LINE CONSTRUCTION JOINING LANE SECTIONS

FIELD OF THE INVENTION

The present invention relates to a bowling alley which includes an approach section, a lane section and a foul line between the approach and lane sections, and more particularly to a bowling alley construction which includes a unique foul line coupling and to a method for resurfacing the approach and/or lane sections which are adjacent to the foul line in such alleys.

BACKGROUND OF THE INVENTION

Bowling alleys are typically constructed of transversely laminated longitudinally extending wood strips having a urethane coated surface. These wood strips are of random lengths and are secured to each other by mechanical fasteners such as nails or adhesive. The approach section of the alley is made of relatively hard maple and terminates in a splice with one of several relatively soft pine sections. The pine sections terminate at a high impact abrasion resistant pin deck.

It is well known in the art that wooden lane surfaces are susceptible to wear and require periodic resurfacing. Such resurfacing comprises sanding of the surface to a uniform level to eliminate cracks, grooves and other damage followed by refinishing, as for example, with a urethane coating. The resurfacing operation takes considerable time and may require the bowling center to be shut down until the operation is completed. For this and other reasons, there has been a trend to resurface existing alleys by the application of decorative synthetic panels to their top surface.

For example, the U.S. Pat. No. 4,406,456 of Berry et al. discloses a method for resurfacing wooden lanes. As disclosed therein the bowling lane is smoothed by sanding to provide a smooth and substantially level substrate for supporting a series of longitudinally extending synthetic panels. The panels which correspond to the lanes maple approach section are of relatively high density, have desirable hardness, tensile strength and stiffness characteristics to distribute bowling ball impact, and support decorative surface panels of a high impact and abrasion resistant synthetic laminate.

The panels corresponding to the pine lane sections are of intermediate density and have an integral decorative upper surface with an impact-resistant coating. In such alleys, a foul line is disposed in a transversely extending groove in the wooden substrate and extends upwardly therefrom between the approach and the head sections. A simulated splice section is silk screened on the head surface at the interface of the rearmost head section and the foremost pine section.

Another approach to a bowling alley construction which incorporates a plurality of synthetic panels is disclosed in the U.S. Pat. No. 5,183,262 of Heddon. As disclosed therein, the panels are juxtaposed so that the tab of one panel fits into the notch of its adjacent panel. One side of a plastic film is attached to the juxtaposed panels with a contact adhesive. A hardened finishing coat is applied to the other side of the film to provide a sliding surface. The film functions as a barrier layer between the finishing coat and the panels top surface so that the bowling lane may be refinished by peeling the film from the lane. The film also attaches to the dowels and the lane to prevent the dowels from popping up when the bowling ball rolls down the lane. A J-shaped foul line coupling is also provided to connect a wood approach panel to a synthetic bowling lane.

It is presently believed that there is a significant commercial demand for an improved bowling alley construction and method for resurfacing a bowling alley in accordance with the present invention. For example, it is believed that there is a demand for a bowling alley construction wherein the foul line ties one or two synthetic panels together at the interface of the approach and lane sections of an alley. The construction should be durable, relatively easy and inexpensive to install and service. In addition, the construction should overcome any problem associated with vertical creep or shifting by the approach and lane sections in the area of the foul line. Any such creep or vertical shifting could result in severe damage to the alley and/or to a patron's bowling ball.

The bowling alley construction and methods for resurfacing lanes in accordance with the present invention are believed to have the aforementioned characteristics. In addition, such methods and construction are designed to minimize any precision work in the field, i.e., reduce the time and skill level of the installer by providing factory finished parts.

SUMMARY OF THE INVENTION

In essence, a bowling alley construction in accordance with the present invention includes an approach section, a lane section and a foul line between the approach section and the lane section. The foul line comprises an elongated relatively flat base portion and an upwardly and transversely extending riser which extends across the width of the lane and the approach sections. The riser has a top surface and two sides with a first of the sides abutting the approach section. A synthetic panel having a thickness which is approximately equal to the height of the riser abuts the second side of the riser and extends over the base of the foul line and over the lane section and is fixed thereto so that the top surface of the riser is essentially flush with the top surface of the synthetic panel and with the top surface of the approach section. One or more fasteners such as screws extend through the synthetic panel at a proximal end thereof, through the base of the foul line and into the lane section to form a rigid structure.

In a preferred embodiment of the invention, the foul line is made of an extruded high density polyethylene and has the shape of an inverted T having a cross member and an intersecting or essentially vertical member. The cross member forms the base of the foul line and the intersecting member forms a vertical riser.

The present invention also contemplates an improved method for resurfacing bowling alleys particularly in the area of the interface between the approach and lane sections, i.e., in the areas adjacent to the foul line. In essence, the method includes the steps of removing the original foul line from between the approach and lane sections of the alley. The upper surfaces of the approach and lane sections of the alley are removed or sanded to a depth which is sufficient to remove scratches and blemishes and at the same time provide a relatively smooth surface. A new foul line having a relatively flat transversely extending base portion and an upwardly and transversely extending riser which extends across the width of the lane section of the alley is provided and a groove and shoulder are formed in one of the sections of the alley. The groove is cut into the section adjacent to the foul line's normal position and cut to a depth such that the shoulder has a height which is essentially equal to the thickness of the base portion of the foul line. The foul line is then inserted or forced into the groove with one side of its base portion abutting the shoulder and with the opposite side of the base portion abutting the second section. A synthetic panel having first and second ends and a thickness which is essentially equal to the height of the riser is provided and installed with a first end of the synthetic panel abutting against a first side of the riser, over the base portion of the foul line and over the first section of the alley. The synthetic panel is then fastened to the first section of the alley and to the base portion of the foul line.

The invention will now be described in connection with the accompanying drawings.

DESCRIPTION OF THE PREFERRED EMBODIMENTS OF THE INVENTION

Figure 1:
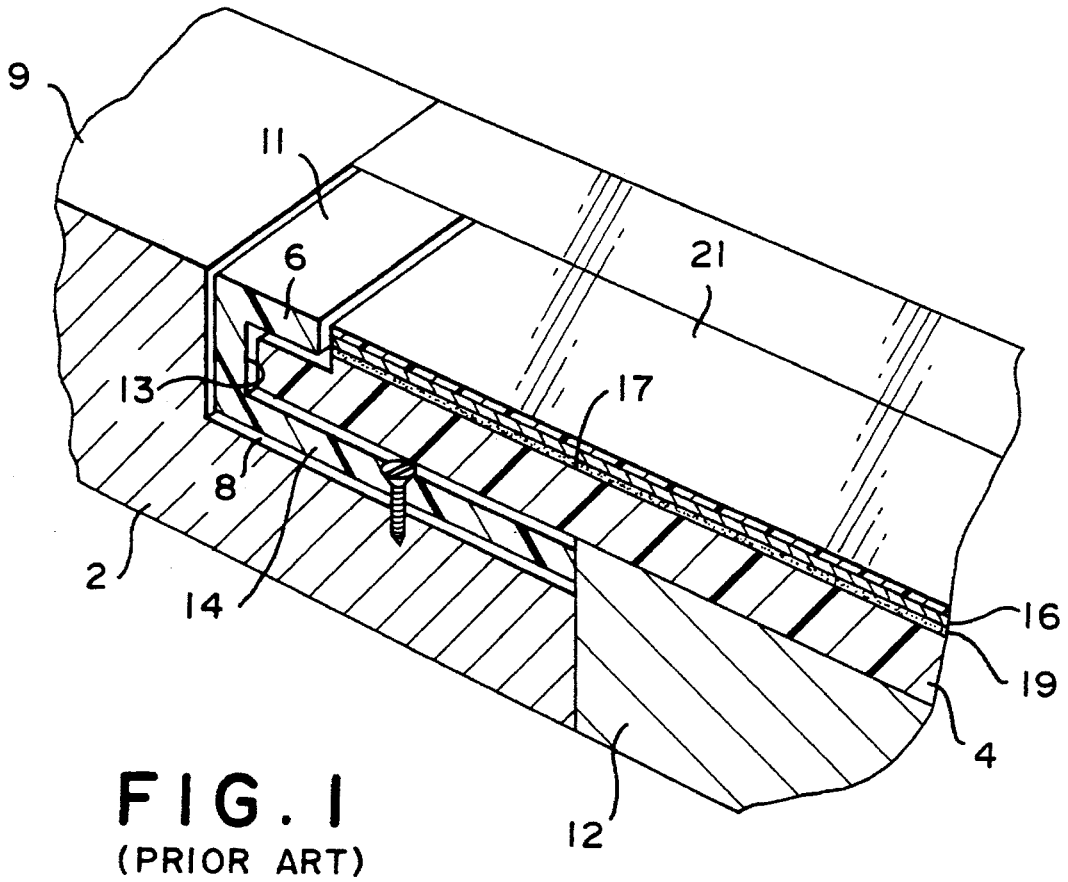
FIG. 1 (PRIOR ART)
FIG. 1 is a perspective view of a prior art bowling alley construction which shows the approach and lane sections of the alley and a J-shaped foul line coupling.

A prior art bowling alley construction which includes an approach section, a lane section and a foul line separating the approach and lane sections is shown in FIG. 1. As illustrated therein, an approach panel or section 2 is coupled to a synthetic lane panel 4 by a J-shaped foul line coupling 6 to form a contiguous bowling lane. The J-shaped foul line coupling 6 rests on step 8 which is carved out of the approach section 2. The approach section 2 has a flat top surface 9 that is aligned with a flat top surface 11 of the J-shaped foul line coupling 6. By contrast, a top surface 13 of lane panel or section 4 is not coplanar with the surface 11 of coupling 6, but is lower than or below that surface and forms a step up junction with the surface 11 of coupling 6.

The synthetic lane panel or section 4 rests on a bottom portion 14 of the foul line coupling 6. The synthetic lane panel 4 also forms a step at one end that is coupled to an open portion 13 of the foul line coupling 6. A plastic film barrier 16 is attached to the flat top surface 17 with adhesive layer 19 in a conventional manner. As shown, the plastic film barrier 16 does not extend onto the top surface 11 of foul line coupling 6. Since film barrier 16 does not extend onto the surface 11, it is less likely to tear when a bowling ball strikes the lane section 4 during use. Lane finish material 21 is applied over the plastic film barrier 16. Therefore, the top surface of the lane section 4 is covered with the lane finish material 21 so that it is coplanar with the top surface 11 and top surface 9.

The bowling alley construction in accordance with a preferred embodiment of the present invention differs substantially from the aforementioned prior art construction. For example, the construction in accordance with the present invention incorporates a foul line that lies between the approach section and the lane section, i.e., at the junction of the hard wood in the approach section and the softer wood which is customarily used in the lane section of an alley. It is presently believed that this approach facilitates resurfacing and minimizes work in the field. It is also believed that this approach is more suitable for installation in a typical bowling alley.

Figure 2:
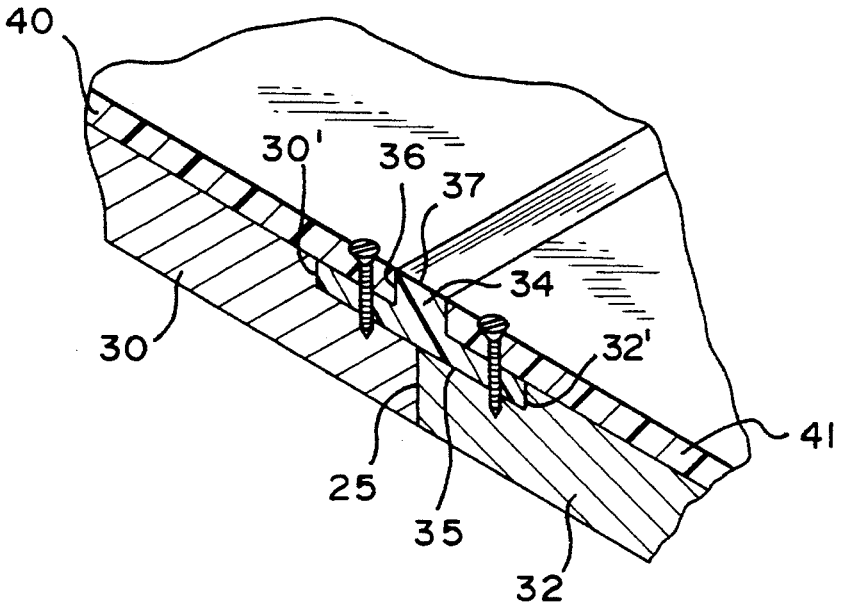
FIG. 2 is a perspective view of a bowling alley construction in accordance with the preferred embodiment of the invention.
Figure 3:
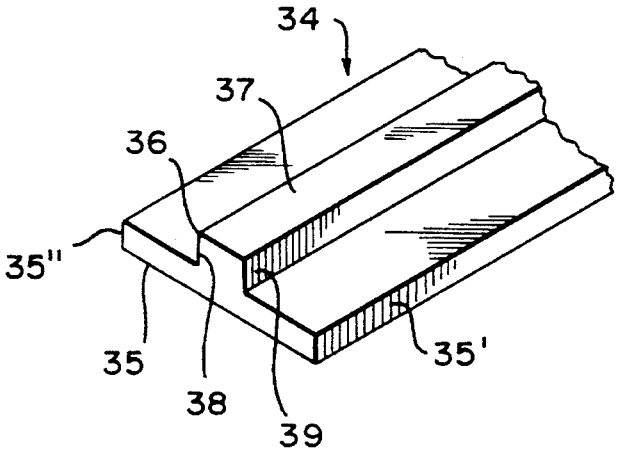
FIG. 3 is a perspective view of a foul line coupling of the type used in a preferred embodiment of the invention.

As illustrated in FIG. 2, a bowling alley construction, in accordance with a preferred embodiment of the invention, includes an approach section 30, a lane section 32 and a foul line coupling or foul line 34 as it will be referred to hereinafter. The foul line 34 is preferably an extruded high density polyethylene and is disposed between the approach section 30 and the lane section 32. In the preferred embodiment of the invention, the foul line 34 has or defines the shape of an inverted T and includes an elongated relatively flat base portion 35 having a pair of ends 35' and 35" and an upwardly and transversely extending riser 36 disposed midway between the ends 35' and 35" of the base portion 35. The foul line 34 extends across the width of the approach and lane sections 30 and 32 with a first of the ends 35' of the base portion 35 abutting a shoulder 30' which has been cut or carved into the approach section 30 as, for example, with a router. A second of the ends 35' of the base portion 35 abuts a shoulder 32' which is cut into the lane section 32. The riser 36 includes a top surface 37 and two parallel sides 38 and 39.

A pair of synthetic panels 40 and 41 are manufactured from an ultra high molecular weight polymer. The panels 40 and 41 having respective widths which are equal to the widths of the approach section 30 and lane section 32 are installed over sections 30 and 32 in a conventional manner. For example, the sections 30 and 32 are sanded to provide a smooth level surface as a substrate for panels 40 and 41 which are held in place by a plurality of recessed screws and adhesive. Each of the panels 40 and 41 have a thickness which is approximately equal to the height of the riser 36. The proximal ends of the panels 40 and 41 are fit tightly against or abut the first and second sides 38 and 39 of the riser 36 and rest on top of the top surfaces of the base portions 35 of foul line 34. In this manner the top surface 37 of riser 36 is essentially flush with the top surface of the panels 40 and 41.

In the practice of the present invention, the foul line 34 is installed at the interface or but joint 25 of the approach section 30 and lane section 32. A groove and shoulder are then formed in each section as, for example, with a router to form a notch which accommodates the base 35 of the foul line 34 as illustrated in FIG. 2.

Figure 4:
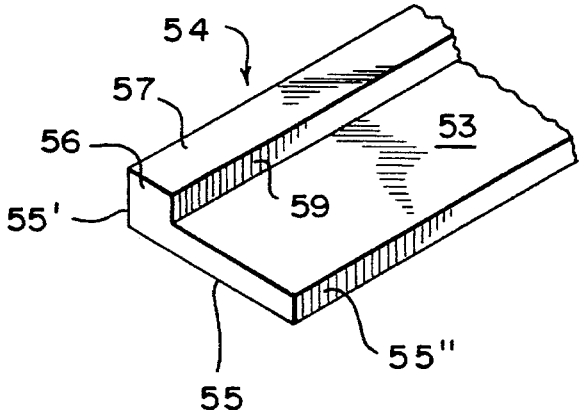
FIG. 4 is a perspective view of a foul line coupling of the type used in a second embodiment of the invention; and, FIG. 5 is a cross sectional view of a bowling alley construction in accordance with a second embodiment of the invention.
Figure 5:
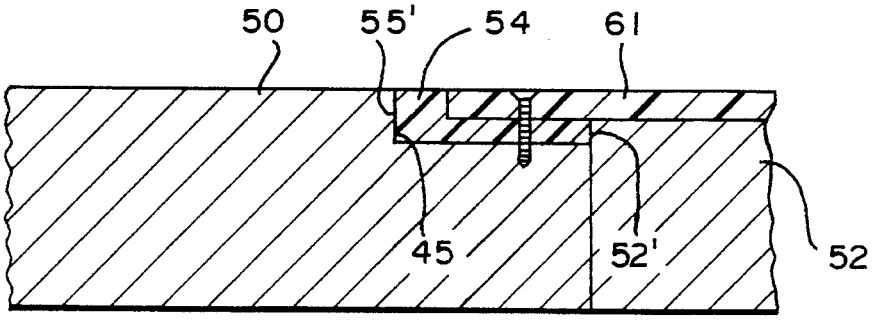

A second embodiment of the invention is illustrated in FIGS. 4 and 5 which shows an L-shaped foul line construction 54. The L-shaped foul line 54 is preferred for those installations where an approach section 50 is lightly sanded and refinished without the installation of a synthetic panel.

The L-shaped foul line 54 is inserted between the approach section 50 and lane section 52 as shown in FIG. 5. The foul line 54 has an L shape which is formed by a pair of intersecting elements. A first of the elements forms an elongated relatively flat base portion 55 having a pair of ends 55' and 55". The foul line 54 extends across the width of the approach and lane sections 50 and 52 with a first of its ends 55' abutting the approach section 50.

In the second embodiment of the invention, the end 55' extends upwardly to thereby form one wall of a riser 56 which forms the short leg of the L-shaped cross section. The riser 56 includes a flat top surface 57 and a second vertical side wall 59 while the base portion 55 also includes an upper surface 53.

As shown in FIG. 5, the lane section 52 has a groove and shoulder cut or carved therein immediately adjacent to its intersection 45 with the approach section 50. The foul line 54 is inserted into the groove with its end 55" abutting the shoulder and its opposite end 55' abutting the approach section 50. A panel 61 is then placed on top of section 52 with its proximal end abutting the side wall 59 of riser 56. The panel 61 rests on panel 52 but overlaps the top surface 53 of the base portion 55. A plurality of screws 63 (one shown) pass through panel 61, the base portion 55 of foul line 54 and into section 52 to tie the assembly into a rigid structure with the top surface 57 of foul line 54 and panel 61 forming a flush or relatively flat and level surface.

A method in accordance with a preferred embodiment of the invention includes the steps of a) removing the original foul line from between the approach and lane sections of the alley and removing the upper surfaces of the approach and lane sections of the alley to a depth which is sufficient to remove scratches and blemishes and provide relatively smooth surfaces. A new foul line which defines a transversely extending inverted T-shaped coupling with a base portion and an upwardly and transversely extending riser which extends across the width of the lane section of the alley is then provided. A groove and shoulder are formed in one of the sections of the alley with the groove adjacent to the foul line's normal position and with the shoulder having a height which is essentially equal to the thickness of the base portion of the foul line. A groove and shoulder are also formed in second of the sections of the alley with the groove adjacent to the foul line's normal position and with the shoulder having a height which is essentially equal to the thickness of the base portion of the foul line. Thereafter, the foul line is inserted in the groove with one side of the base portion abutting the shoulder and with the opposite side of the base portion abutting the second section. A pair of synthetic panels having first and second ends and thicknesses which are essentially equal to the height of the riser are provided and a first end of each of the synthetic panels is forced against or abuts opposite sides of the riser and over the base portions of the foul line and the first and second sections of the alley.

Finally, the panels are fastened to the first and second sections of the alley and to the base portion of the foul line.

While the invention has been described in connection with its preferred embodiments, it should be recognized that changes and modifications may be made therein without departing from the scope of the appended claims.

What is claimed is:

1. In a bowling alley of the type having an approach section, a lane section and a foul line separating the approach and lane sections and a synthetic panel covering one of the sections, the improvement comprising an elongated transversely extending foul line coupling having an inverted T-shaped cross-section including an elongated relatively flat base portion having a height and a pair of ends and an upwardly and transversely extending riser disposed between said ends of said base portion and extending across said lane and said approach sections, each of said approach and said lane sections including a groove and a shoulder with said grooves adjacent to said foul line and in which a height of said shoulder is essentially equal to the height of said base portion and with a first of said ends of said base portion extending into said groove and abutting said shoulder in said approach section and a second of said ends of said base portion extending into said groove and abutting said shoulder in said lane section, said riser including a top surface and two sides, said synthetic panel having a thickness which is approximately equal to a height of said riser, abutting said riser and extending over a portion of said base portion on said foul line coupling, and fastening means passing through a proximal end of said synthetic panel, through the base portion of said foul line coupling and into one of the sections of the alley.

2. In a bowling alley in accordance with claim 1, the improvement further comprising an extruded high density polyethylene foul line construction.

3. A bowling alley construction comprising an approach section and a lane section having common widths and a foul line between said approach section and said lane section, said foul line having an inverted T-shaped cross-section comprising an elongated relatively flat base portion having a height and a pair of ends, and an upwardly and transversely extending riser disposed between said ends of said base portion and extending across the width of said lane and said approach sections, each of said approach and said lane sections includes a groove and a shoulder with said grooves adjacent to said foul line and in which a height of said shoulder is essentially equal to the height of said base portion and with a first of said ends of said base portion extending into said groove and abutting said shoulder in said approach section and a second of said ends of said base portion extending into said groove and abutting said shoulder in said lane section, said riser including a top surface and two parallel sides, and first and second synthetic panels each having a thickness which is approximately equal to a height of said riser and widths which are essentially equal to the widths of said approach and lane sections, said panels abutting said first and said second sides of said riser and extending over said base portion of said foul line and over said approach and lane sections and fixed thereto by a fastener extending through each of the synthetic panels at a proximal end thereof, through said base portion of said foul line and into the approach and lane section to form a rigid structure so that said top surface of said riser is essentially flush with the top surface of said synthetic panels.

* * * * *